United States Patent [19]

Shirai et al.

[11] Patent Number: 4,942,854

[45] Date of Patent: Jul. 24, 1990

[54] VALVE OPERATING DEVICE FOR USE IN INTERNAL COMBUSTION ENGINE

[75] Inventors: Hiroshi Shirai; Takashi Tatsumi; Hisashi Kanda; Koichi Fukuo; Masahiko Motsumoto; Toshiaki Hiro, all of Saitama, Japan

[73] Assignee: Honda Giken Kogyo Kabushiki Kaisha, Tokyo, Japan

[21] Appl. No.: 317,771

[22] Filed: Mar. 2, 1989

[30] Foreign Application Priority Data

| | | | |
|---|---|---|---|
| Mar. 3, 1988 | [JP] | Japan | 63-50426 |
| Apr. 1, 1988 | [JP] | Japan | 63-81602 |
| May 30, 1988 | [JP] | Japan | 63-132499 |
| May 30, 1988 | [JP] | Japan | 63-132500 |
| May 30, 1988 | [JP] | Japan | 63-132501 |

[51] Int. Cl.[5] ..... F01L 1/34; F01L 1/08

[52] U.S. Cl. ..... 123/90.17; 123/90.6

[58] Field of Search ..... 123/90.16, 90.17, 90.6; 74/567

[56] References Cited

U.S. PATENT DOCUMENTS

| | | | |
|---|---|---|---|
| 2,567,689 | 9/1951 | Bishop | 123/90.6 |
| 2,647,500 | 8/1953 | Lang | 123/90.6 |
| 3,298,332 | 1/1967 | Elsbett | 123/90.6 |
| 4,151,817 | 5/1979 | Mueller | 123/90.16 |
| 4,424,790 | 1/1984 | Curtil | 123/90.6 |
| 4,442,806 | 4/1984 | Matsuura et al. | 123/90.16 |
| 4,469,061 | 9/1984 | Ajiki et al. | 123/90.16 |
| 4,475,497 | 10/1984 | Honda et al. | 123/90.16 |
| 4,480,617 | 11/1984 | Nakano et al. | 123/90.16 |
| 4,481,919 | 11/1984 | Honda et al. | 123/90.16 |
| 4,515,121 | 5/1985 | Matsuura et al. | 123/90.16 |
| 4,538,559 | 9/1985 | Imamura et al. | 123/90.6 |
| 4,567,861 | 2/1986 | Hara et al. | 123/90.16 |
| 4,570,582 | 2/1986 | Speil | 123/90.55 |
| 4,587,936 | 5/1986 | Matsuura et al. | 123/90.46 |
| 4,615,307 | 10/1986 | Kodama et al. | 123/90.16 |
| 4,777,914 | 10/1988 | Konno | 123/90.16 |
| 4,779,589 | 10/1988 | Matsuura et al. | 123/90.15 |

FOREIGN PATENT DOCUMENTS

| | | | |
|---|---|---|---|
| 0332359 | 9/1989 | European Pat. Off. . | |
| 919799 | 7/1949 | Fed. Rep. of Germany | 123/90.6 |
| 3236800 | 4/1984 | Fed. Rep. of Germany | 123/90.6 |
| 2185784 | 7/1987 | United Kingdom . | |

*Primary Examiner*—Charles J. Myhre
*Assistant Examiner*—Weilun Lo
*Attorney, Agent, or Firm*—Lyon & Lyon

[57] ABSTRACT

A valve operating device for operating an intake or exhaust valve in an internal combustion engine includes a cam having a cam profile including a valve lifting portion for applying a force to open the engine valve and a base circle portion for allowing the valve to be closed, the cam profile having a valve opening point and a valve closing point between the valve lifting portion and the base circle portion, a cam follower slidably engaging the cam, and a hydraulic lash adjuster combined with the cam follower for eliminating any gap between the means and the engine valve. The base circle portion has a gradient cam surface or a combination of different gradient cam surfaces for canceling out valve-lifting radial displacement of the base circle portion.

26 Claims, 13 Drawing Sheets

FIG. 1.
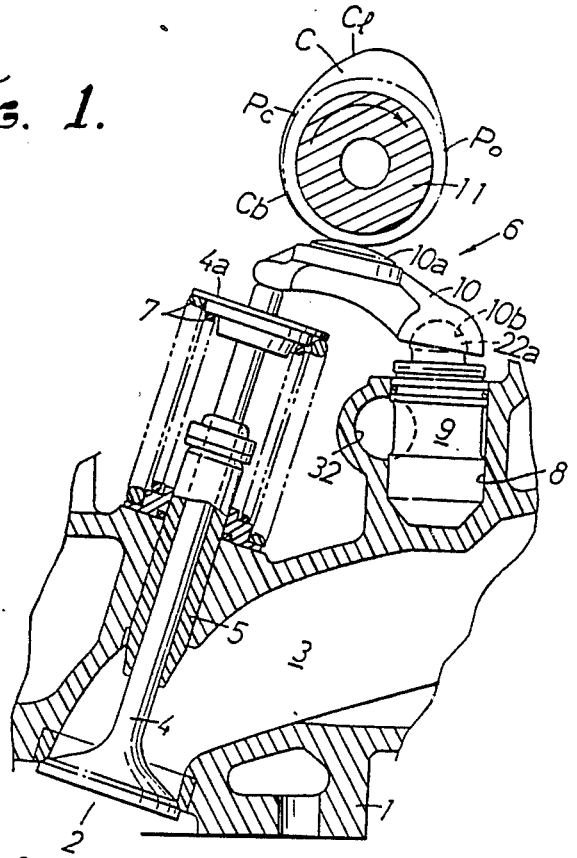
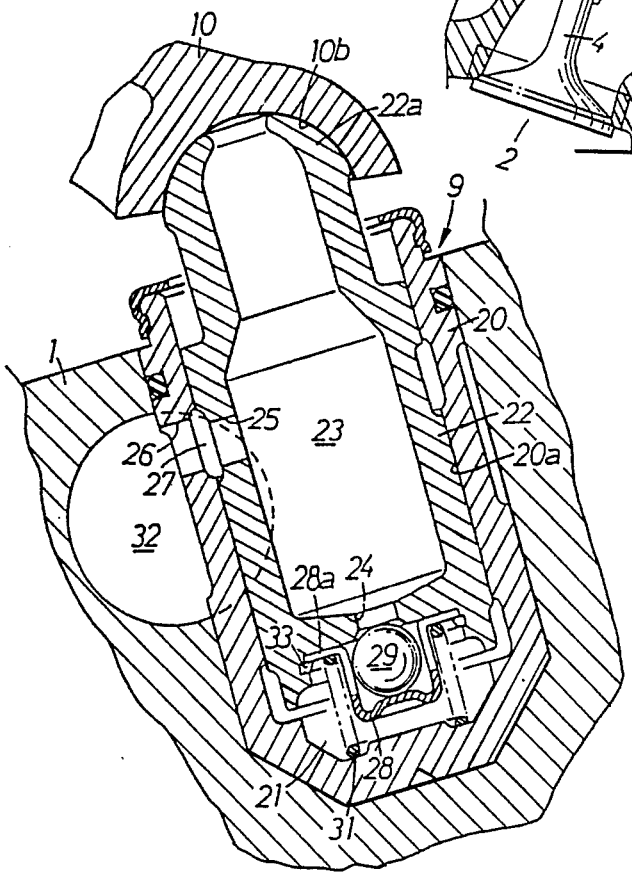
FIG. 2.

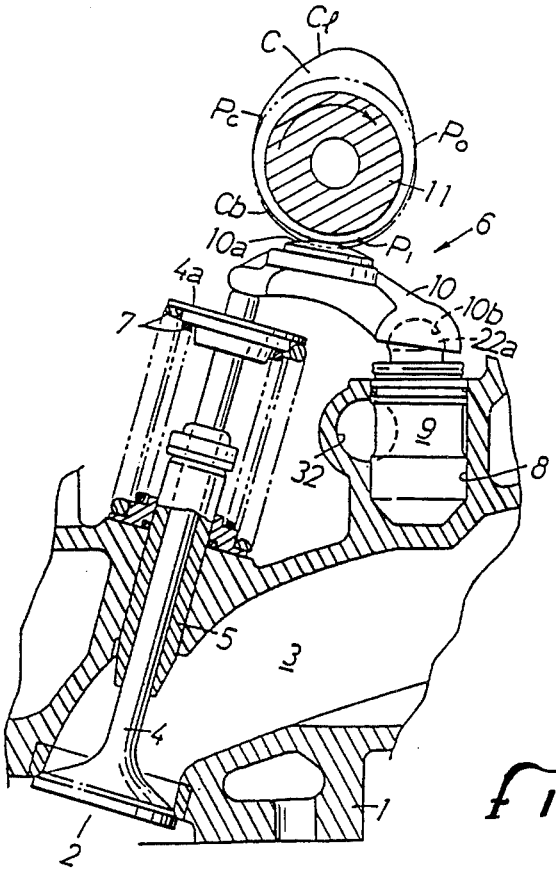
FIG. 5.
FIG. 6.
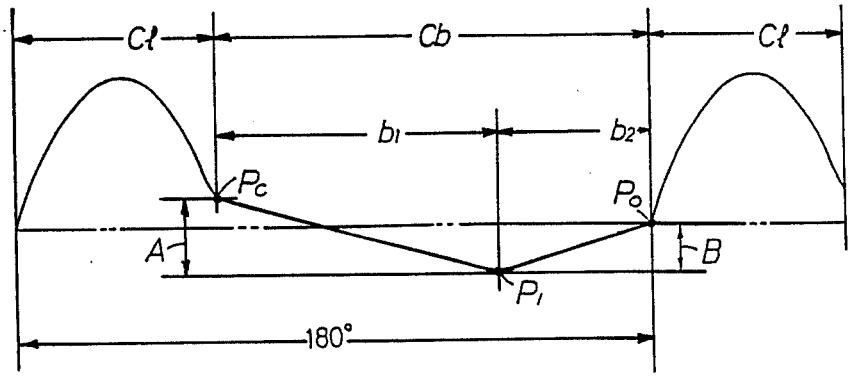

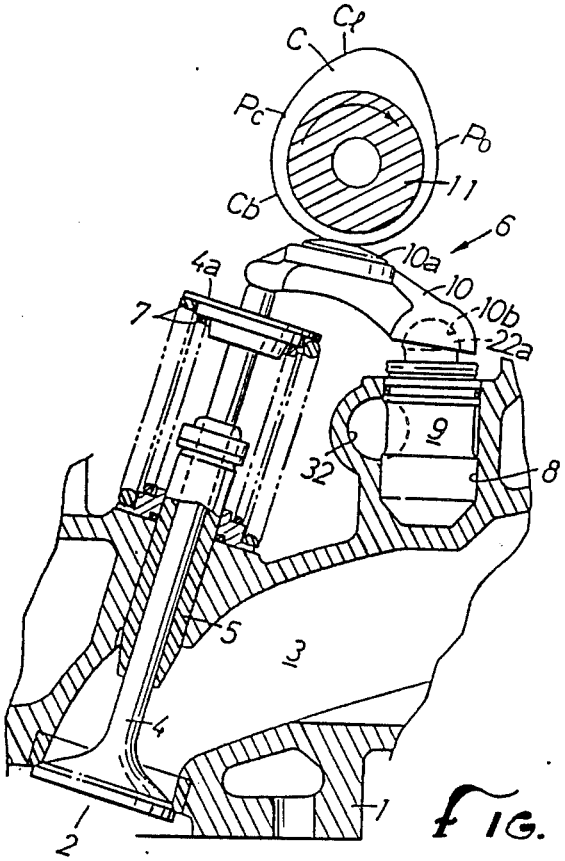
FIG. 10.
FIG. 11.
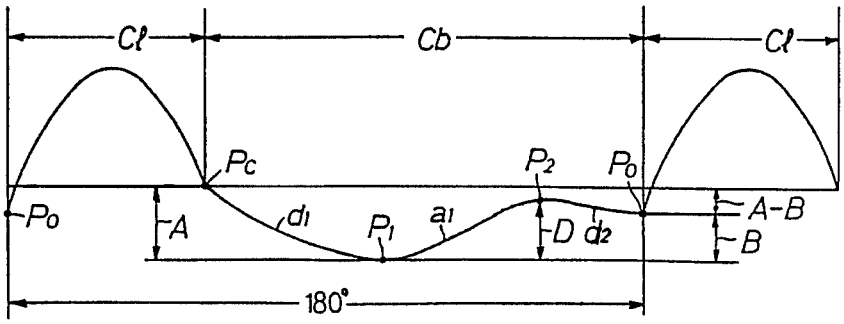

VALVE OPERATING DEVICE FOR USE IN INTERNAL COMBUSTION ENGINE

BACKGROUND OF THE INVENTION

1. Field of the Invention

The present invention relates to a valve operating device for operating a valve such as an intake valve or an exhaust valve in an internal combustion engine.

2. Prior Art

One conventional valve operating device for use in an internal combustion engine includes a camshaft having a cam for alternately opening and closing an engine valve such as an intake valve or an exhaust valve in the engine, the engine valve being held against one end of a cam follower or rocker arm, the other end of which engages a hydraulic lash adjuster. The cam has a cam profile composed of a cam lobe and a base circle portion. The cam has on its cam profile a valve opening point where the rocker arm contacting the cam opens the valve and a valve closing point where the rocker arm contacting the cam closes the engine valve. The base circle portion includes a gradient cam surface sloping progressively downwardly toward the circumference of the base circle or radially inwardly with respect to the cam, in a circumferential direction from the valve closing point toward the valve opening point for preventing the engine valve from suffering a valve closing failure due to cam vibration resulting from undesirable radial displacement or flexure of the camshaft. The radial distance between the valve opening and closing points is selected to correspond to, or be slightly smaller than, a play or lift loss in the hydraulic lash adjuster for allowing certain unwanted radial valve-lifting displacement of the base circle portion to be canceled out or offset by the radially inwardly sloping gradient cam surface of the base circle portion, without varying the timing to open the valve. Such a valve operating device is disclosed in U.S. Pat. No. 4,538,559, for example. The disclosed hydraulic lash adjuster includes a check valve in the form of a ball normally biased in a closing direction by a spring. Any play or lift loss in the hydraulic lash adjuster is therefore limited to the amount of resilient depression of its plunger on account of compressive deformation of air bubbles in the oil in the lash adjuster at the time the lash adjuster is under load, and the amount of depression of the plunger due to hydraulic pressure leakage therefrom while the engine valve is being closed.

The amount of resilient depression and the amount of leakage-dependent depression of the plunger of the lash adjuster generally range from 20 to 30 μm. Therefore, the radial distance between the valve closing and opening points on the cam profile is also in the range of from 20 to 30 μm at most insofar as the timing to open the engine valve is not varied. However, the base circle portion of the cam is often subject to radial valve-lifting displacements beyond the above numerical range due to machining errors, flexure, or the like, and hence such radial valve-lifting displacements cannot be offset by the radially inward gradient on the base circle portion.

One solution would be to increase the amount of depression of the plunger of the lash adjuster due to hydraulic pressure leakage from the plunger, thereby increasing the radially inward gradient on the base circle portion. However, such a scheme would result in a reduction in the maximum opening the engine valve can provide for supplying an air-fuel mixture into the combustion chamber, so that the output power of the engine would be lowered.

The inventors have found that large radial valve-lifting displacement of the base circle portion of the cam tends to occur in a localized region, particularly, immediately after the engine valve has been closed, rather than throughout the entire cam profile between the valve closing and opening points. It has also been found that where the internal combustion engine has a plurality of engine valves of one type on a common camshaft, the base circle portions of the cams are liable to undergo different valve-lifting displacements dependent on the positions of the cams. If such localized or different valve-lifting displacements are to be canceled out by the conventional valve operating device, the play in the hydraulic lash adjuster has to be increased and so does the radially inward gradient on the base circle portion between the valve closing and opening points. The increased play in the hydraulic lash adjuster, however, modifies the opening characteristics or pattern of the engine valve, i.e., delays the opening timing of all engine valves and reduces the opening strokes of the valves.

SUMMARY OF THE INVENTION

In view of the aforesaid drawbacks of the conventional valve operating device, it is an object of the present invention to provide a valve operating device for an internal combustion engine, which includes a cam having a large gradient on a base circle portion thereof without involving an increase in the amount of depression of the plunger of a hydraulic lash adjuster due to hydraulic pressure leakage, so that large radial displacements of the base circle portion can be canceled out or offset effectively by the gradient on the base circle portion and the hydraulic lash adjuster.

Another object of the present invention is to provide a valve operating device for an internal combustion engine, which will prevent a large valve-lifting displacement of the base circle portion of a cam from affecting an engine valve immediately after the engine valve has been closed.

Still another object of the present invention is to provide a valve operating device for an internal combustion engine, which will prevent large localized valve-lifting displacements of the base circle portion of a cam from affecting an engine valve without increasing a play or lift loss in a hydraulic lash adjuster.

According to the present invention, there is provided a valve operating device for operating an engine valve in an internal combustion engine, comprising: a valve spring for normally urging the engine valve in a closing direction; a cam having a cam profile including a valve lifting portion for applying a force to open said engine valve and a base circle portion for allowing said valve to be closed, said cam profile having a valve opening point and a valve closing point between said valve lifting portion and said base circle portion; transmitting means for transmitting the force from said cam to said engine valve; a hydraulic lash adjuster combined with said transmitting means for eliminating any gap between said means and said engine valve, said hydraulic lash adjuster comprising an oil pressure chamber, a plunger movable into said oil pressure chamber in response to the force from said transmitting means and defining an oil chamber therein which normally communicates with said oil pressure chamber through a valve hole defined in said plunger, and a free-ball-type check valve which is movable to close said valve hole only dependent on a pressure buildup in said oil pressure chamber; and said base circle portion of the cam profile having a downward gradient surface sloping progressively radially inwardly from said valve closing point toward said valve opening point, said base circle portion having a radial height A, as converted to the stroke of movement of said plunger, between said valve closing and opening points, said radial height A being selected to meet the following relationship:

$$l_{1B}+L<A\leqq l_{1A}+l_{1B}+L$$

where $l_{1A}$ represents the amount of initial depression of said plunger which is required to cause said check valve to close said valve hole;

$l_{1B}$ represents the amount of resilient depression of said plunger which is caused by the compression of air bubbles in oil in said oil pressure chamber; and L represents the amount of depression of said plunger upon oil leakage from said oil pressure chamber while said engine valve is being closed.

According to the present invention, there is also provided a valve operating device for operating an engine valve in an internal combustion engine, comprising: a valve spring for normally urging the engine valve in a closing direction; a cam having a cam profile including a valve lifting portion for applying a force to open said engine valve and a base circle portion for allowing said valve to be closed, said cam profile having a valve opening point and a valve closing point between said valve lifting portion and said base circle portion; transmitting means for transmitting the force from said cam to said engine valve; a hydraulic lash adjuster combined with said transmitting means for eliminating any gap between said means and said engine valve; said base circle portion of the cam profile having a downward gradient surface sloping progressively radially inwardly from said valve closing point toward an intermediate point between said valve closing and opening points, and an upward gradient surface sloping progressively radially outwardly from said intermediate point toward said valve opening point, said upward gradient surface having a gradient smaller than the gradient of a valve opening curve of said valve lifting portion.

According to the present invention, there is further provided a valve operating device for operating an engine valve in an internal combustion engine, comprising: a valve spring for normally urging the engine valve in a closing direction; a cam having a cam profile including a valve lifting portion for applying a force to open said engine valve and a base circle portion for allowing said said valve to be closed, said cam profile having a valve opening point and a valve closing point between said valve lifting portion and said base circle portion; transmitting means for transmitting the force from said cam to said engine valve; a hydraulic lash adjuster combined with said transmitting means for eliminating any gap between said means and said engine valve; said base circle portion of the cam profile having a first downward gradient surface sloping progressively radially inwardly from said valve closing point toward a first intermediate point between said valve closing and opening points, an upward gradient surface sloping progressively radially outwardly from said first intermediate point toward a second intermediate point between said first intermediate point and said valve opening point, said upward gradient surface having a gradient smaller than the gradient of a valve opening curve of said valve lifting portion, and a second downward gradient surface sloping progressively radially inwardly from said second intermediate point toward said valve opening point or a third intermediate point between said second intermediate point and said valve opening point, said first downward gradient surface has a radial height A, as converted to the stroke of movement of said hydraulic lash adjuster, and said base circle portion has a radial height B, as converted to the stroke of movement of said hydraulic lash adjuster, between said first intermediate point and said valve opening point, said radial heights A and B being selected to meet the following relationship:

$$A\geqq B$$

$$L_0\geqq A-B$$

where $L_0$ represents the play in said hydraulic lash adjuster.

According to the present invention, there is also provided a valve operating device for operating an engine valve in an internal combustion engine, comprising: a valve spring for normally urging the engine valve in a closing direction; a cam having a cam profile including a valve lifting portion for applying a force to open said engine valve and a base circle portion for allowing said valve to be closed, said cam profile having a valve opening point and a valve closing point between said valve lifting portion and said base circle portion; transmitting means for transmitting the force from said cam to said engine valve; a hydraulic lash adjuster combined with said transmitting means for eliminating any gap between said means and said engine valve; said base circle portion of the cam profile having a steep downward gradient surface sloping progressively radially inwardly from said valve closing point toward a first intermediate point between said valve closing and opening points, and a no-gradient or constant radius surface extending from said first intermediate point toward said valve closing point, said base circle portion has a radial height A, as converted to the stroke of movement of said hydraulic lash adjuster, between said valve closing and opening points, said radial height A being selected to meet the following relationship:

$$A\leqq L_0$$

where $L_0$ represents the play in said hydraulic lash adjuster.

According to the present invention, there is also provided a valve operating device for operating an engine valve in an internal combustion engine, comprising: a valve spring for normally urging the engine valve in a closing direction; a cam having a cam profile including a valve lifting portion for applying a force to open said engine valve and a base circle portion for allowing said valve to be closed, said cam profile having a valve opening point and a valve closing point between said valve lifting portion and said base circle portion; transmitting means for transmitting the force from said cam to said engine valve; a hydraulic lash adjuster combined with said transmitting means for eliminating any gap between said means and said engine valve; said base circle portion of the cam profile having a gradual downward gradient surface sloping progressively radially inwardly from said valve closing point toward an intermediate point between said valve closing and opening points, and a steep gradient surface extending from said intermediate point toward said valve closing point, said steep upward gradient surface being steeper than said gradual downward gradient surface, said base circle portion has a radial height A, as converted to the stroke of movement of said hydraulic lash adjuster, between said valve closing and opening points, said radial height A being selected to meet the following relationship:

$$A \leqq L_0$$

where $L_0$ represents the play in said hydraulic lash adjuster.

According to the present invention, there is further provided a valve operating device for operating an engine valve in an internal combustion engine, comprising: a valve spring for normally urging the engine valve in a closing direction; a cam having a cam profile including a valve lifting portion for applying a force to open said engine valve and a base circle portion for allowing said valve to be closed, said cam profile having a valve opening point and a valve closing point between said valve lifting portion and said base circle portion; transmitting means for transmitting the force from said cam to said engine valve; a hydraulic lash adjuster combined with said transmitting means for eliminating any gap between said means and said engine valve; said base circle portion of the cam profile having a steep downward gradient surface sloping progressively radially inwardly from said valve closing point toward an intermediate point between said valve closing and opening points, and a gradual downward gradient surface extending from said intermediate point toward said valve opening point, said gradual downward gradient surface being less steep than said steep downward gradient surface, said base circle portion has a radial height A, as converted to the stroke of movement of said hydraulic lash adjuster, between said valve closing and opening points, said radial height A being selected to meet the following relationship:

$$A \leqq L_0$$

where $L_0$ represents the play in said hydraulic lash adjuster.

According to the present invention, there is also provided a valve operating device for operating an engine valve in an internal combustion engine, comprising: a valve spring for normally urging the engine valve in a closing direction; a cam having a cam profile including a valve lifting portion for applying a force to open said engine valve and a base circle portion for allowing said valve to be closed, said cam profile having a valve opening point and a valve closing point between said valve lifting portion and said base circle portion; transmitting means for transmitting the force from said cam to said engine valve; a hydraulic lash adjuster combined with said transmitting means for eliminating any gap between said means and said engine valve; said base circle portion of the cam profile having a steep downward gradient surface sloping progressively radially inwardly from said valve closing point toward an intermediate point between said valve closing and opening points, and a no-gradient surface extending from said intermediate point toward said valve opening point, said base circle portion has a radial height A, as converted to the stroke of movement of said hydraulic lash adjuster, between said valve closing and opening points, said radial height A being selected to meet the following relationship:

$$A \leqq L_0$$

where $L_0$ represents the play in said hydraulic lash adjuster.

According to the present invention, there is also provided a valve operating device for operating a plurality of engine valves in an internal combustion engine, comprising: a plurality of valve springs for normally urging the engine valves in a closing direction; a plurality of cams having respective cam profiles including respective valve lifting portions for applying forces to open said engine valves and respective base circle portions for allowing said valves to be closed; transmitting means for transmitting the force from each of said cams to said engine valve; a hydraulic lash adjuster combined with said transmitting means for eliminating any gap between said means and each of said engine valves; and at least selected ones of said base circle portions having different profiles dependent upon radial displacements thereof in a direction to lift the engine valves.

The above and other objects, features and advantages of the present invention will become more apparent from the following description when taken in conjunction with the accompanying drawings in which preferred embodiments of the present invention are shown by way of illustrative example.

BRIEF DESCRIPTION OF THE DRAWINGS

FIG. 1 is a vertical cross-sectional view of a valve operating device according to an embodiment of the present invention;

FIG. 2 is an enlarged vertical cross-sectional view of a hydraulic lash adjuster;

FIG. 5 is a vertical cross-sectional view of a valve operating device according to another embodiment of the present invention;

FIG. 6 is a developed diagram of a cam profile of the valve operating device shown in FIG. 5;

FIG. 10 is a vertical cross-sectional view of a valve operating device according to still another embodiment of the present invention;

FIG. 11 is a developed diagram of a cam profile of the valve operating device illustrated in FIG. 10;

DETAILED DESCRIPTION OF THE PREFERRED EMBODIMENTS

Figure 3:
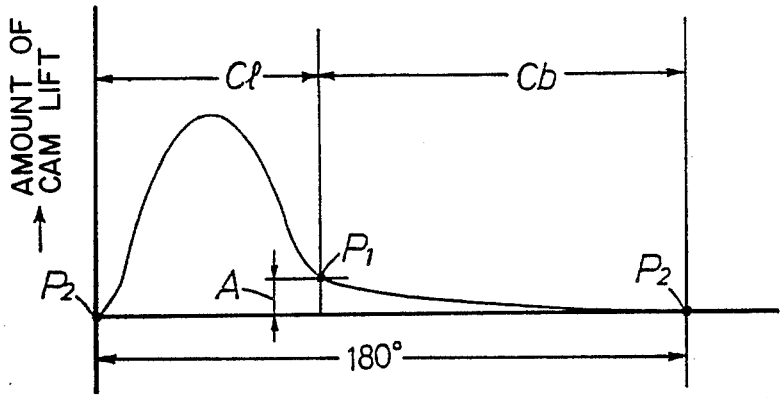
FIG. 3 is a developed diagram showing a cam profile of the valve operating device shown in FIG. 1.

Like or corresponding parts are denoted by like or corresponding reference characters throughout views.

FIG. 1 shows in cross section a valve operating device according to an embodiment of the present invention, incorporated in an internal combustion engine. The internal combustion engine has a cylinder head 1 defining therein a combustion chamber 2 and a port 3 communicating with the combustion chamber 2. The port 3 can selectively be opened and closed by an engine valve 4 such as an intake valve or an exhaust valve.

The engine valve 4 is longitudinally movably supported in the cylinder head 1 by a valve guide 5, and can be operated by the valve operating device, generally denoted at 6, to open and close the port 3.

The valve operating device 6 comprises a valve spring 7 disposed under compression between a retainer 4*a* fixed to the upper end of the valve stem of the engine valve 4 and the cylinder head 1 for normally urging the engine valve 4 in a direction to close the port 3, a hydraulic lash adjuster 9 mounted in a support hole 8 defined in the cylinder head 1, a cam follower or rocker arm 10 swingably supported on the hydraulic lash adjuster 9 at one end and having an opposite distal end engaging the upper end of the valve stem of the engine valve 4, and a camshaft 11 having a cam C thereon which is held in slidable contact with a slipper surface 10*a* on the upper side of the cam follower 10.

As shown in FIGS. 1 and 3, the cam C has a cam profile including a cam lobe or valve lifting portion Cl for opening the engine valve 4 and a base circle portion Cb for allowing the engine valve 4 to be closed. The valve lifting portion Cl and a base circle portion Cb are joined to each other at their boundaries or junctions, one junction serving as a valve closing point Pc and the other as a valve opening point Po. The base circle portion Cb has a gradient cam surface sloping progressively downwardly toward the circumference of the base circle or radially inwardly with respect to the cam C, in a circumferential direction from the valve closing point Pc toward the valve opening point Po. The radial distance between these valve closing and opening points Pc, Po will be described later on.

The hydraulic lash adjuster 9 will be described in detail with reference to FIG. 2. The hydraulic lash adjuster 9 comprises a bottomed cylinder 20 and a plunger 22 slidably fitted in a cylinder bore 20*a* defined in the cylinder 20 and defining an oil pressure chamber 21 between the bottom of the cylinder 20 and the bottom of the plunger 22. The cylinder 20 is fitted in the support hole 8. The plunger 22 has an outer semispherical end 22*a* engaging in a semispherical recess 10*b* defined in one end of the cam follower 10.

The plunger 22 has an oil chamber 23 defined therein and a valve hole 24 defined in the bottom or lower end thereof in communication with the hydraulic pressure chamber 21. The oil chamber 23 communicates with an oil supply passage 32 defined in the cylinder head 1 through an oil hole 25 in a side wall of the plunger 22, an annular oil passage 27 between sliding surfaces of the cylinder 20 and the plunger 22, and an oil hole 26 in a side wall of the cylinder 20. The oil supply passage 32 is connected to the outlet port of an oil pump (not shown) driven by the engine. Therefore, the oil chamber 23 is filled with oil from the A hat-shaped cage 28 has a flange 28*a* fitted in the lower end of the plunger 22 and secured thereto by a ring 33. A check valve 29 in the form of a freely movable ball is disposed in the cage 28 for opening and closing the valve hole 24, the stroke of movement of the check valve 29 being limited by the valve cage 28. The check valve 29 is not spring-loaded in a direction to close the valve hole 24, but can close the valve hole 24 only in response to a pressure The oil pressure chamber 21 houses therein a tension spring 31 for normally biasing the plunger 22 in an upward direction so as to project upwardly from the cylinder When the cam C is rotated to cause the valve lifting portion Cl to press the slipper surface 10*a* of the cam follower 10, the plunger 22 is pressed toward the hydraulic pressure chamber 21. The oil pressure chamber 21 therefore develops a pressure buildup, forcing a small amount of oil from the oil pressure chamber 21 via the valve hole 24 into the oil chamber 23. Therefore, the plunger 22 is initially depressed, after which the check valve 29 closes the valve hole 24 to keep a hydraulic pressure within the oil pressure chamber 21. Then, air bubbles trapped in the oil in the oil pressure chamber 21 are compressed to allow the plunger 22 to be resiliently depressed, followed by a quick pressure buildup in the oil pressure chamber 21. This pressure buildup enables the plunger 22 to withstand the downward force applied to the plunger 22 by the cam follower 10. The cam follower 10 is therefore swung about the semispherical end 22*a* by the valve lifting portion Cl to open the engine valve 4 against the bias of the valve spring 7.

While the engine valve 4 is being opened, the high-pressure oil in the oil pressure chamber 21 slightly leaks into the gap between the sliding surfaces of the cylinder 20 and the plunger 22, whereupon the plunger 22 is depressed due to such an oil leakage.

Then, when the base circle portion Cb of the cam C comes into contact with the cam follower 10, the valve spring 7 lifts the engine valve 4 and the cam follower 10 to close the port 3. The tension spring 31 also lifts the plunger 22 to hold the slipper surface 10*a* of the cam follower 10 against the cam C, thus eliminating any gap between the upper end of the valve stem and the cam follower 10.

The upward movement of the plunger 22 under the bias of the tension spring 31 results in a reduction in the pressure in the oil pressure chamber 21, thus allowing the check valve 29 to open the valve hole 24. The oil in the oil chamber 23 is then supplied through the valve hole 24 into the oil pressure chamber 21 to make up for the oil leakage from the oil pressure chamber 21.

It is now assumed that $l_{1A}$ represents the amount of initial depression of the plunger 22 which is required to cause the check valve 29 to close the valve hole 24, $l_{1B}$ the amount of resilient depression of the plunger 22 which is caused by the compression of the air bubbles in the oil in the oil pressure chamber 21, L the amount of depression of the plunger 22 upon oil leakage from the oil pressure chamber 21 while the engine valve 4 is being closed, and $l_2$ the amount of returning movement of the plunger 22 when it is released from the force applied by the cam C to open the engine valve 4. Then, the radial distance, indicated by A, as converted to the stroke of displacement of the plunger 22, between the valve closing and opening points Pc, Po on the base circle portion Cb of the cam C is selected to meet the following relationships:

$$l_{1B}+L<A \leqq l_{1A}+l_{1B}+L \quad (1)$$

$$A+l_2>A+l_{1B} \quad (2)$$

Figure 4:
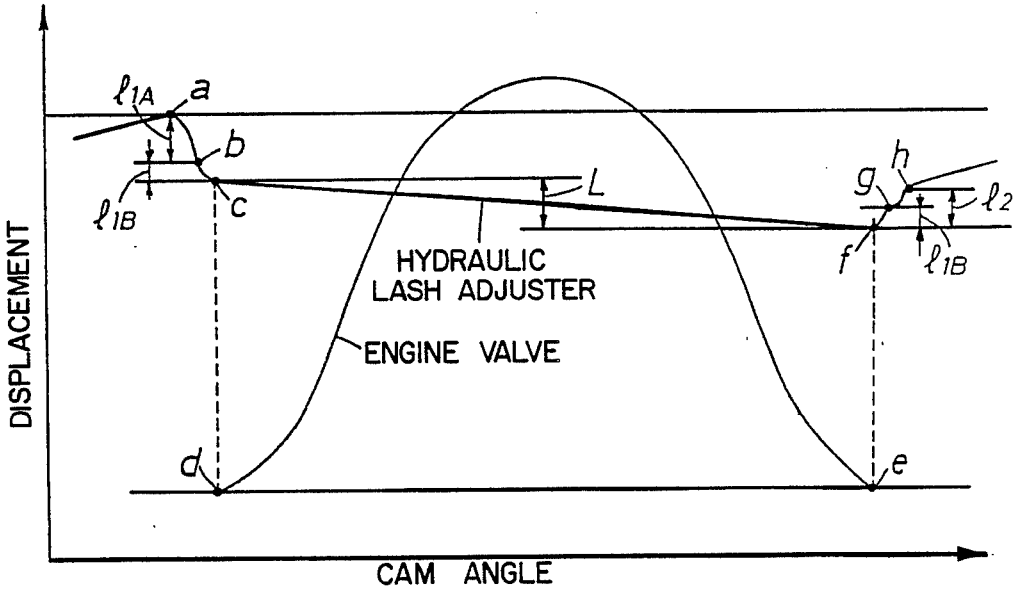
FIG. 4 is a diagram showing the manner in which the hydraulic lash adjuster and an engine valve are displaced during rotation of a cam of the valve operating device of FIG. 1.

Operation of the valve operating device of the above embodiment will be described below. FIG. 4 shows the manner in which the hydraulic lash adjuster 9 and the engine valve 4 are displaced during rotation of the cam C. In FIG. 4, the plunger 22 starts being depressed by the valve lifting portion Cl of the cam C at a point a. The check valve 29 closes the valve hole 24 at a point b, after which the plunger 22 is depressed due to the compression of the air bubbles in the oil in the oil pressure chamber 21 between the point b and a point c. The engine valve 4 starts being unseated to open the port 3 at a point d, and is thereafter seated to close the port 3 at a point e. Between a point f and a point g, the plunger 22 is extended or pushed back upwardly due to a repulsive force from the compressed air bubbles in the oil in the oil pressure chamber 21. The plunger 22 is then fully returned under the bias of the tension spring 31 to eliminate the gap between the upper end of the valve stem and the cam follower 10 at a point h.

After the point h and before the point a is reached again, the plunger 22 is extended along the downward gradient cam surface of the base circle portion Cb while keeping the check valve 29 open. Even if the cam C is radially displaced in a direction to lift the engine valve 4 due to radial displacement or flexure of the camshaft 11, since the downward gradient of the base circle portion Cb is large as can be understood from the inequality (1) above, such radial displacement of the cam C can be canceled out or offset almost entirely by the gradient of the base circle portion Cb. Accordingly, the engine valve 4 is not subjected to unwanted forces tending to open the engine valve 4, and remains closed.

The stroke ($l_{1A}+l_{1B}+L$) of displacement-absorbing movement of the hydraulic lash adjuster 9 is very large, and hence any valve-lifting radial displacement of the base circle portion Cb which cannot be offset by the downward gradient thereof can reliably be canceled out by the hydraulic lash adjuster 9 itself.

The amount $l_{1A}$ of initial depression of the plunger 22 can freely be selected by varying the stroke of opening and closing movement of the check valve 29 in the hydraulic lash adjuster 9. Inasmuch as the ability of the hydraulic lash adjuster 9 to withstand the force applied by the cam C to open the engine valve 4 is not impaired by the freely selected amount of initial depression of the plunger 22, the degree to which the engine valve 4 can be opened is not reduced by the free selection of the amount of initial depression of the plunger 22.

When the plunger 22 is fully moved back at the point h, it is released without fail from the repulsive force from the compressed air bubbles in the oil pressure chamber 21, as can be seen from the inequality (2) above. Consequently, a failure of the engine valve 4 to close the port 4, which would otherwise result from a remaining repulsive force from the compressed air bubbles, is reliably avoided.

FIG. 5 shows a valve operating device 6 according to another embodiment of the present invention. The valve operating device 6 includes a cam C having a cam profile including a cam lobe or valve lifting portion Cl for opening the engine valve 4 and a base circle portion Cb for allowing the engine valve 4 to be closed. The valve lifting portion Cl and a base circle portion Cb are joined to each other at their boundaries or junctions, one junction serving as a valve closing point Pc and the other as a valve opening point Po. The base circle portion Cb, as best illustrated in FIG. 6, has a downward gradient cam surface $b_1$ sloping progressively downwardly or radially inwardly with respect to the cam C in a circumferential direction from the valve closing point Pc toward an intermediate point $P_1$ between the valve closing point Pc and the valve opening point Po, and an upward gradient cam surface $b_2$ sloping progressively upwardly or radially outwardly with respect to the cam C in a circumferential direction from the intermediate point $P_1$ toward the valve opening point Po. The upward gradient of the upward gradient cam surface $b_1$ is smaller than the upward gradient of a valve opening curve of the valve lifting portion Cl of the cam C.

It is assumed that $L_o$ represents the play in the hydraulic lash adjuster 9, the play $L_0$ being equal to ($l_{1A}+l_{1B}+L$). Then, the radial height A, as converted to the stroke of displacement of the plunger 22, of the downward gradient surface $b_1$ on the base circle portion Cb of the cam C, and the radial height, as converted to the stroke of displacement of the plunger 22, of the upward gradient surface $b_2$ on the base circle portion Cb, are selected to meet the following relationship:

$$L_0=l_{1A}+l_{1B}+L \geqq A \geqq B \quad (3)$$

Figure 7:
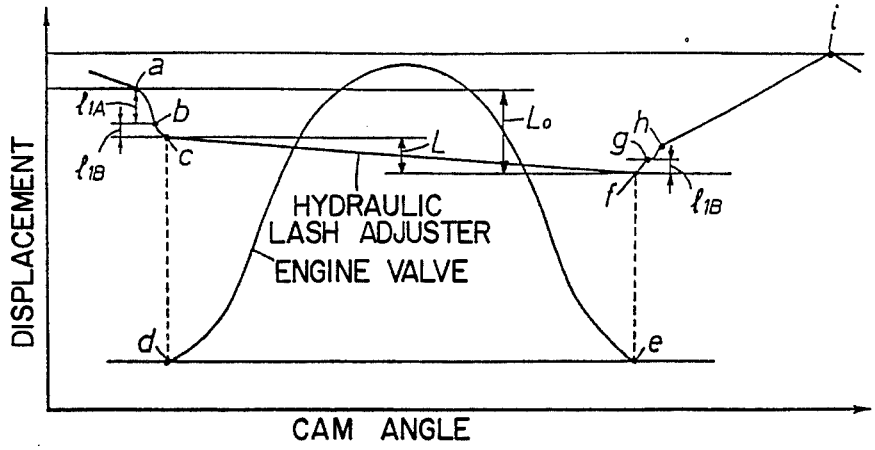
FIG. 7 is a diagram showing the manner in which the hydraulic lash adjuster and an engine valve are displaced during rotation of a cam of the valve operating device of FIG. 5.

Operation of the valve operating device of the embodiment shown in FIGS. 5 and 6 will be described below. FIG. 7 shows the manner in which the hydraulic lash adjuster 9 and the engine valve 4 are displaced during rotation of the cam C. In FIG. 7, the plunger 22 starts being depressed by the valve lifting portion Cl of the cam C at a point a. The check valve 29 closes the valve hole 24 at a point b, after which the plunger 22 is depressed due to the compression of the air bubbles in the oil in the oil pressure chamber 21 between the point b and a point c. The engine valve 4 starts being unseated to open the port 3 at a point d, and is thereafter seated to close the port 3 at a point e. Between a point f and a point g, the plunger 22 is extended or pushed back upwardly due to a repulsive force from the compressed air bubbles in the oil in the oil pressure chamber 21. The plunger 22 is then fully returned under the bias of the tension spring 31 to eliminate the gap between the upper end of the valve stem and the cam follower 10 at a point h.

After the point h and before a point i is reached, the plunger 22 is extended along the downward gradient cam surface $b_1$ of the base circle portion Cb while keeping the check valve 29 open. Since the downward gradient surface $b_1$ extends downwardly or radially inwardly from the valve closing point Pc to the intermediate point $P_1$, the gradient of the downward gradient surface $b_1$ is relatively steep. Therefore, even if the cam C is radially displaced in a direction to lift the engine valve 4 immediately after the engine valve 4 is closed, such unwanted radial displacement of the cam C can be canceled out or offset by the large gradient of the downward gradient surface $b_1$. As a result, the engine valve 4 is not subjected to unwanted forces tending to open the engine valve 4, and remains closed.

Any valve-lifting radial displacement of the cam C, which cannot be offset by the gradient of the downward gradient surface $b_1$, can be canceled out by the play $L_0$ in the hydraulic lash adjuster 9 itself.

The amount $l_{1A}$ of initial depression of the plunger 22 can freely be selected by varying the stroke of opening and closing movement of the check valve 29 in the hydraulic lash adjuster 9. Inasmuch as it is possible to increase the play $L^0$ without impairing the ability of the hydraulic lash adjuster 9 to withstand the force applied by the cam C to open the engine valve 4, the degree to which the hydraulic lash adjuster 9 can absorb or cancel out valve-lifting radial displacement of the cam C can be increased, so that unwanted remaining radial displacement of the cam C can reliably be canceled out.

After the point i and until the point a is reached again, the plunger 22 is depressed along the upward gradient cam surface b, of the base circle portion Cb. Since the gradient of the upward gradient surface $b_2$ is smaller than the gradient of the valve opening curve of the valve lifting portion Cl, the speed at which the plunger 22 is depressed between the points i and a is low enough not to close the check valve 29 in the hydraulic lash adjuster 9.

Figure 8:
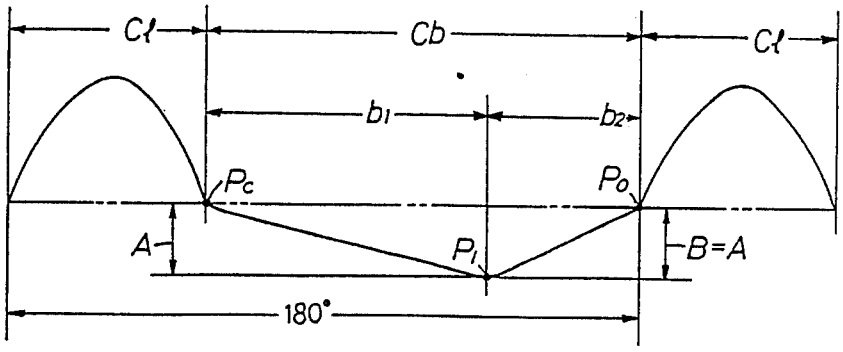
FIGS. 8 and 9 are developed diagrams of cam profiles according to other embodiments of the present invention.
Figure 9:
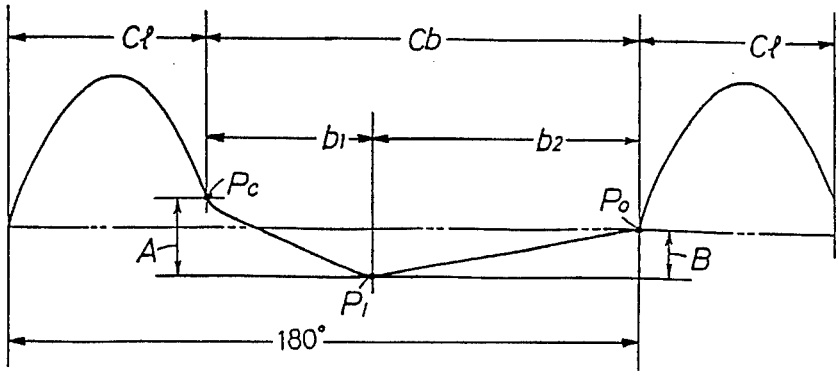

FIGS. 8 and 9 illustrate cam profiles according to other embodiments of the present invention. The cam profile shown in FIG. 8 is substantially the same as the cam profile of FIG. 6 except that the radial height A of the downward gradient surface $b_1$ of the base circle portion Cb is equal to the radial height B of the upward gradient surface $b_2$. The cam profile of FIG. 9 is substantially the same as the cam profile of FIG. 6 except that the gradient of the downward gradient surface $b_1$ is larger than the gradient of the upward gradient surface $b_2$.

Figure 12:
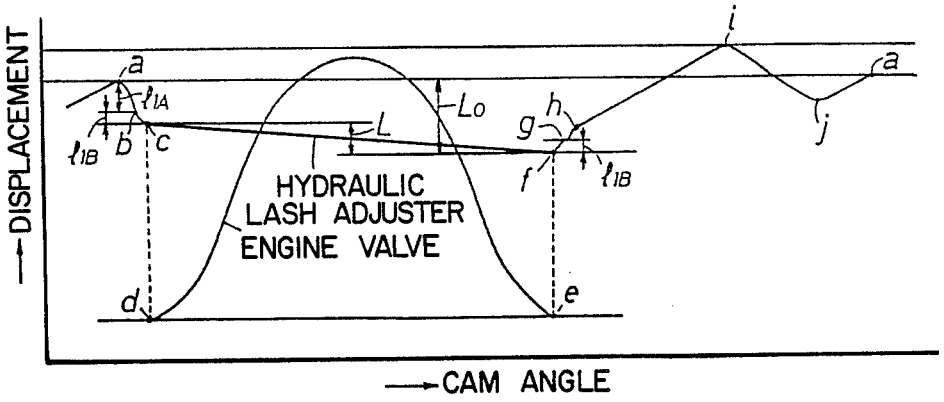
FIG. 12 is a diagram showing the manner in which the hydraulic lash adjuster and an engine valve are displaced placed during rotation of a cam of the valve operating device of FIG. 10.

FIGS. 10 through 12 show a valve operating device 6 including a cam C having a cam profile according to still another embodiment of the present invention. As shown in FIG. 11, the cam profile includes a cam lobe or valve lifting portion Cl for opening the engine valve 4 and a base circle portion Cb for allowing the engine valve 4 to be closed. The valve lifting portion Cl and a base circle portion Cb are joined to each other at their boundaries or junctions, one junction serving as a valve closing point Pc and the other as a valve opening point Po. The base circle portion Cb has first and second intermediate points $P^1$, $P^2$ successively from the valve closing point Pc. The base circle portion Cb also has a first downward gradient cam surface $d_1$ sloping progressively downwardly or radially inwardly with respect to the cam C, in a circumferential direction from the valve closing point Pc toward the first intermediate point $P_1$, an upward gradient cam surface $a_1$ sloping progressively upwardly or radially outwardly with respect to the cam C in a circumferential direction from the first intermediate point $P_1$ toward the second intermediate point $P_2$, and a second downward gradient cam surface $d_2$ sloping progressively downwardly or radially inwardly with respect to the cam C, in a circumferential direction from the second intermediate point $P_2$ toward the valve opening point Po. The upward gradient of the upward gradient cam surface $a_1$ is smaller than the upward gradient of a valve opening curve of the valve lifting portion Cl of the cam C.

According to the embodiment shown in FIGS. 10 and 11, the radial height A, as converted to the stroke of displacement of the plunger 22, of the first downward gradient surface $d_1$ on the base circle portion Cb of the cam C, and the radial height B, as converted to the stroke of displacement of the plunger 22, between the first intermediate point $P_1$ and the valve opening point PO, are selected to meet the following relationships:

$$A \geqq B \tag{4}$$

$$L_0 \geqq A - B \tag{5}$$

The radial height D of the upward gradient surface $a_1$ is smaller than the radial height A.

Operation of the valve operating device of the embodiment shown in FIGS. 10 and 11 will be described below. FIG. 12 shows the manner in which the hydraulic lash adjuster 9 and the engine valve 4 are displaced during rotation of the cam C. In FIG. 10, the plunger 22 starts being depressed by the valve lifting portion Cl of the cam C at a point a. The check valve 29 closes the valve hole 24 at a point b, after which the plunger 22 is depressed due to the compression of the air bubbles in the oil in the oil pressure chamber 21 between the point b and a point c. The engine valve 4 starts being unseated to open the port 3 at a point d, and is thereafter seated to close the port 3 at a point e. Between a point f and a point g, the plunger 22 is extended or pushed back upwardly due to a repulsive force from the compressed air bubbles in the oil in the oil pressure chamber 21. The plunger 22 is then fully returned under the bias of the tension spring 31 to eliminate the gap between the upper end of the valve stem and the cam follower 10 at a point h.

After the point h and before a point i is reached, the plunger 22 is extended along the first downward gradient cam surface $d_1$ of the base circle portion Cb while keeping the check valve 29 open. Since the first downward gradient surface $d_1$ extends downwardly or radially inwardly from the valve closing point Pc to the first intermediate point $P_1$, the gradient of the downward gradient surface $d_1$ is relatively large and so is the radial height thereof. Therefore, even if the cam C is radially displaced in a direction to lift the engine valve 4 immediately after the engine valve 4 is closed, such unwanted valve-lifting radial displacement of the cam C can be canceled out or offset by the large gradient and radial height of the first downward gradient surface $d_1$, preventing the check valve 29 from being closed. As a result, the engine valve 4 is not subjected to unwanted forces tending to open the engine valve 4, and remains closed.

Any valve-lifting radial displacement of the cam C which cannot be offset by the gradient of the first downward gradient surface $d_1$ can be canceled out by the play $L_0$ in the hydraulic lash adjuster 9 itself.

After the point i and until a point j is reached, the plunger 22 is depressed along the upward gradient cam surface $a_1$ of the base circle portion Cb. Since the gradient of the upward gradient surface $a_1$ is smaller than the gradient of the valve opening curve of the valve lifting portion Cl, the speed at which the plunger 22 is depressed between the points i and a is low enough not to close the check valve 29 in the hydraulic lash adjuster 9.

After the point j and until the point a is reached again, the plunger 22 is extended along the second downward gradient cam surface $d_2$ of the base circle portion Cb. Even if the cam C is radially displaced in a direction to lift the engine valve 4 immediately before the engine valve 4 is opened, such unwanted valve-lifting radial displacement of the cam C can be canceled out or offset by the downward gradient of the second downward gradient surface $d_2$ and the play $L_0$ in the hydraulic lash adjuster 9, preventing the check valve 29 from being closed.

Therefore, when the valve lifting portion Cl of the cam C is operated again on the cam slipper 10*a*, the check valve 29 is closed at a predetermined timing, so that the timing to start opening the engine valve 4 is stabilized.

Figure 13:
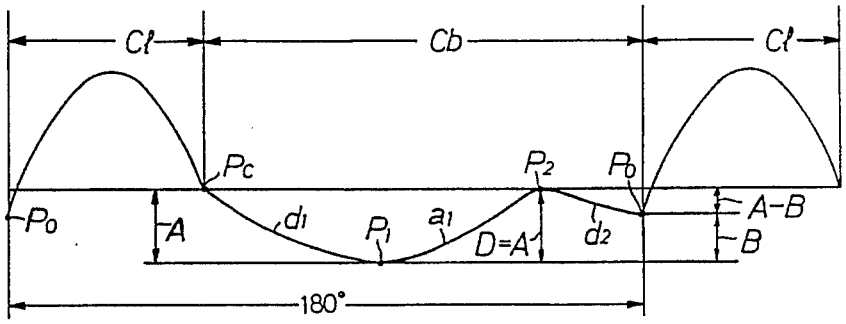
FIGS. 13 through 18 are diagrams showing cam profiles according to modifications of the valve operating device of FIG. 10.

FIG. 13 shows a cam profile according to a modification. In this modification, the radial height D of the upward gradient surface $a_1$ is equal to the radial height A of the first downward gradient surface $d_2$. With this arrangement, the second downward gradient surface $d_2$ is of a relatively large radial height to offset large radial displacement of the cam C immediately prior to the opening of the engine valve 4.

Figure 14:
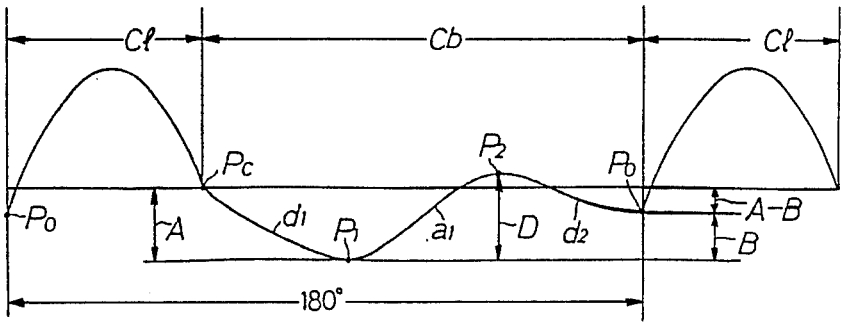

According to another modification shown in FIG. 14, the radial height D of the upward gradient surface $a_1$ is larger than the radial height A of the first downward gradient surface $d_2$ to provide the second downward gradient surface $d_2$ with a greater radial height.

Figure 15:
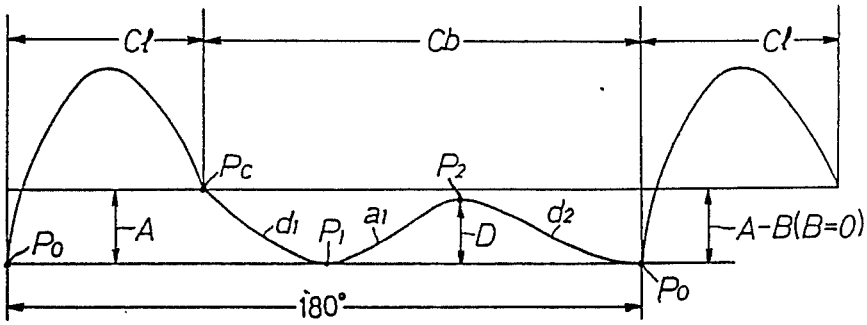

FIG. 15 illustrates still another modified cam profile which differs from the cam profile shown in FIG. 11 in that the first intermediate point $P_1$ and the valve opening point Po are on the same level, i.e., $B=0$, to give a greater radial height to the second downward gradient surface $d_2$.

Figure 16:
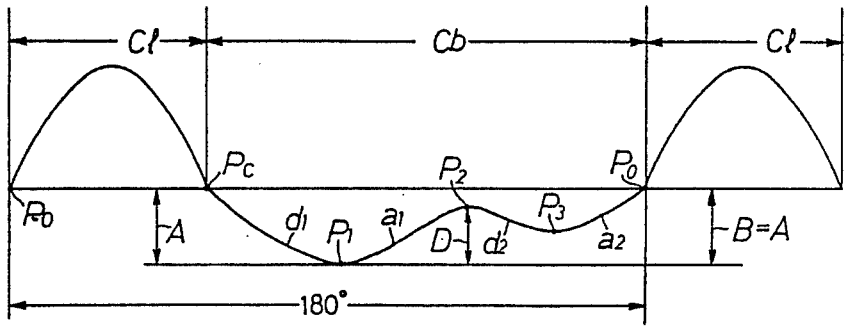

FIG. 16 shows yet another modification which differs from the cam profile of FIG. 11 in that the base circle portion Cb additionally has a second upward gradient cam surface $a_2$ extending between the second downward gradient surface $d_2$ and the valve opening point Po and having an upward gradient smaller than the gradient of the valve opening curve of the valve lifting portion Cl, and that the valve closing point Pc and the valve opening point Po are on the same level, i.e., $A=B$.

Figure 17:
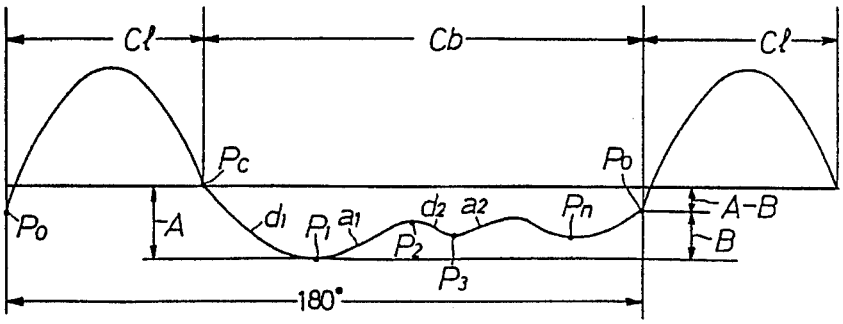

A further modified cam profile shown in FIG. 17 differs from the cam profile of FIG. 11 in that the base circle portion Cb has a plurality of alternate upward and downward gradient cam surfaces subsequent to the first intermediate point $P_1$, these upward and downward gradient surfaces having radial heights smaller than the radial height A of the first downward gradient cam surface $d_1$.

Figure 18:
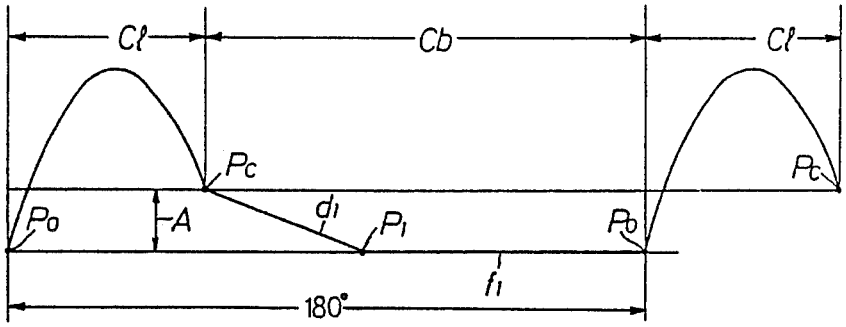

FIG. 18 shows a cam profile in accordance with a further modification of the present invention. The cam profile includes a cam lobe or valve lifting portion Cl for opening the engine valve 4 and a base circle portion Cb for allowing the engine valve 4 to be closed. The valve lifting portion Cl and a base circle portion Cb are joined to each other at their boundaries or junctions, one junction serving as a valve closing point Pc and the other as a valve opening point Po. The base circle portion Cb has a steep downward gradient cam surface $d_1$ sloping progressively downwardly or radially inwardly with respect to the cam C, in a circumferential direction from the valve closing point Pc toward an intermediate point $P_1$ between the valve closing point Pc and the valve opening point Po, and a flat or no-gradient cam surface $f_1$ extending from the intermediate point $P_1$ toward the valve opening point Po.

In the arrangement shown in FIG. 18, the radial height A, as converted to the stroke of displacement of the plunger 22, between the valve closing point Pc and the valve opening point Po is selected to meet the following relationship:

$$A \leqq L_0 \tag{6}$$

Since the rear portion $f_1$ of the base circular portion Cb is flat or has no gradient, the radial height A between the valve closing point Pc and the valve opening point Po is provided fully by the front downward gradient cam surface $d_1$.

Figure 19:
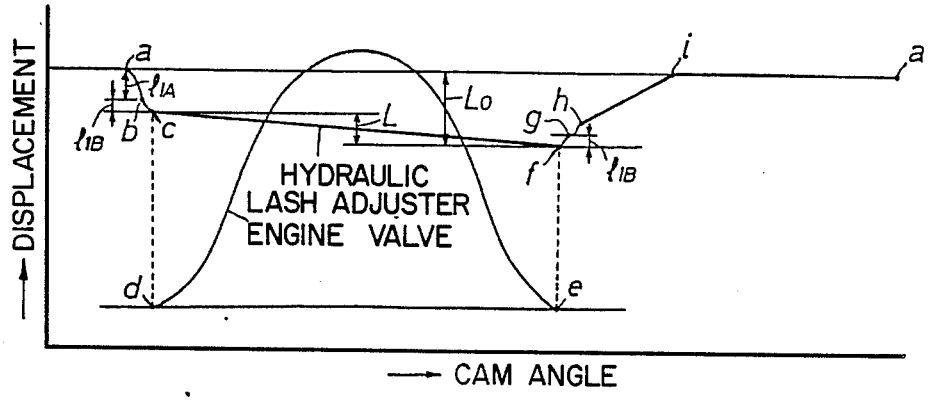
FIG. 19 is a diagram showing the manner in which the hydraulic lash adjuster and an engine valve are displaced during rotation of a cam which has the cam profile shown in FIG. 18.

The valve operating device with the cam profile shown in FIG. 18 operates as follows: FIG. 19 shows the manner in which the hydraulic lash adjuster 9 and the engine valve 4 are displaced during rotation of the cam C. In FIG. 19, the plunger 22 starts being depressed by the valve lifting portion Cl of the cam C at a point a. The check valve 29 closes the valve hole 24 at a point b, after which the plunger 22 is depressed due to the compression of the air bubbles in the oil in the oil pressure chamber 21 between the point b and a point c. The engine valve 4 starts being unseated to open the port 3 at a point d, and is thereafter seated to close the port 3 at a point e. Between a point f and a point g, the plunger 22 is extended or pushed back upwardly due to a repulsive force from the compressed air bubbles in the oil in the oil pressure chamber 21. The plunger 22 is then fully returned under the bias of the tension spring 31 to eliminate the gap between the upper end of the valve stem and the cam follower 10 at a point h.

After the point h and before a point i is reached, the plunger 22 is extended along the steep downward gradient cam surface $d_1$ of the base circle portion Cb while keeping the check valve 29 open. Since the downward gradient surface $d_1$ has the gradient between the valve closing point Pc to the valve opening point Po, the gradient of the downward gradient surface $d_1$ is relatively large and so is the radial height thereof. Therefore, even if the cam C is radially displaced in a direction to lift the engine valve 4 immediately after the engine valve 4 is closed, such unwanted valve-lifting radial displacement of the cam C can be canceled out or offset by the large gradient and radial height of the downward gradient surface $d_1$, preventing the check valve 29 from being closed. As a result, the engine valve 4 is not subjected to unwanted forces tending to open the engine valve 4, and remains closed.

Any valve-lifting radial displacement of the cam C which cannot be offset by the gradient of the steep downward gradient surface $d_1$ can be canceled out by the play $L_0$ in the hydraulic lash adjuster 9 itself.

After the point i and until the point a is reached again, the plunger 22 is held at rest because the cam follower engages the flat of constant radius cam surface $f_1$ of the base circle portion Cb. If the cam C is radially displaced in a direction to lift the engine valve 4, such valve-lifting radial displacement is canceled out by the play $L_0$ in the hydraulic lash adjuster 9, while preventing the check valve 19 from being closed.

Therefore, any large valve-lifting radial displacement of the cam C immediately after the engine valve 4 is closed is effectively offset by the limited gradient cam surface $d_1$ having the radial height A, of the base circle portion Cb between the valve closing and opening points Pc, Po. Therefore, when the valve lifting portion Cl of the cam C is operated again on the cam slipper 10*a*, the check valve 29 is closed at a predetermined timing, so that the timing to start opening the engine valve 4 is stabilized.

Figure 20:
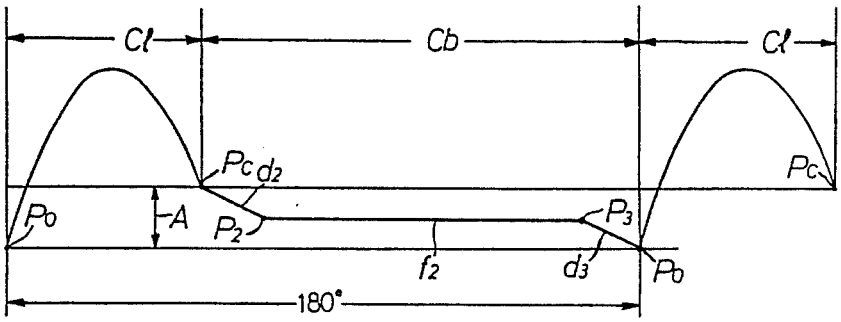
FIGS. 20 through 25 are diagrams illustrating cam profiles according to other modifications of the valve operating device of FIG. 10.

FIG. 20 shows a cam profile according to a modification. In this modified cam profile, the base circle portion Cb has a radial height A, and comprises a first steep downward gradient cam surface $d_2$ sloping progressively downwardly or radially inwardly from the valve closing point Pc toward a first intermediate point $P_2$ which is positioned closer to the valve closing point Pc than the center of the base circle portion Cb, the first gradient cam surface $d_2$ having a radial height of about A/2, a flat or constant radius or no-gradient cam surface $f_2$ extending with no gradient from the first intermediate point $P_2$ toward a second intermediate point $P_3$ relatively near the valve opening point Po, and a second steep downward gradient cam surface $d_3$ sloping progressively downwardly or radially inwardly from the second intermediate point $P_3$ toward the valve opening point Po and having a radial height of about A/2.

The cam profile shown in FIG. 20 can offset large valve-lifting radial displacement of the base circle portion Cb immediately after the engine valve 4 is closed and immediately before the engine valve 4 is opened.

Figure 21:
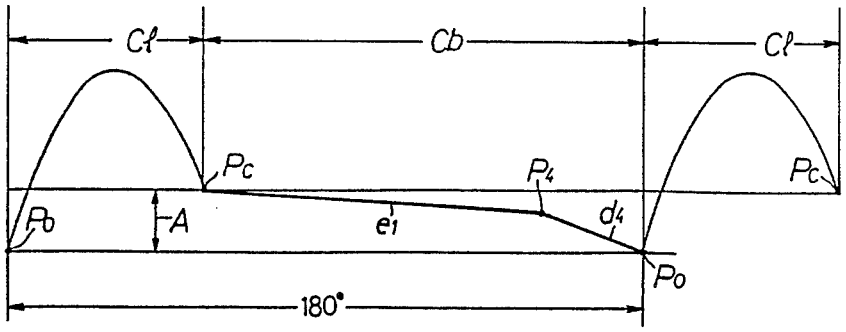

FIG. 21 illustrates a cam profile according to another modification. In FIG. 21, the base circle portion Cb has a radial height A, and comprises a gradual downward gradient cam surface $e_1$ sloping progressively downwardly or radially inwardly from the valve closing point Pc toward an intermediate point $P_4$ which is positioned closer to the valve opening point Po than the valve closing point Pc, the gradual gradient cam surface $e_1$ having a radial height of about A/3, and a steep downward gradient cam surface $d_4$, steeper than the gradual gradient cam surface $e_1$, sloping progressively downwardly or radially inwardly from the intermediate point $P_4$ toward the valve opening point Po and having a radial height of about A/3.

The cam profile of FIG. 21 is effective in canceling out small valve-lifting radial displacement of the base circle portion Cb after the engine valve 4 is closed and large valve-lifting radial displacement of the base circle portion Cb immediately before the engine valve 4 is opened.

Figure 22:
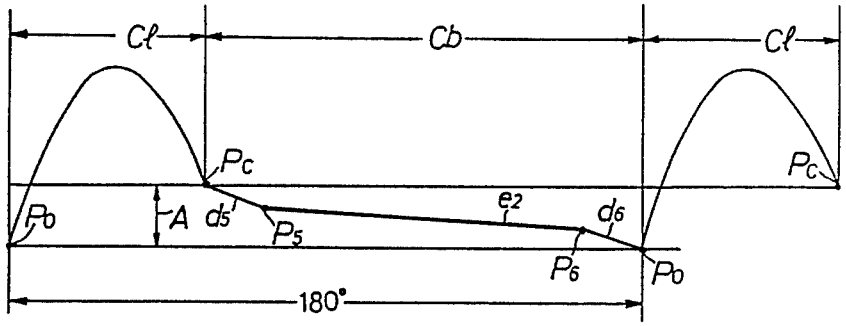

FIG. 22 shows a cam profile according to a still further modification. According to this modification, the base circle portion Cb has a radial height A, and comprises a first steep downward gradient cam surface $d_5$ sloping progressively downwardly or radially inwardly from the valve closing point Pc toward a first intermediate point $P_5$ which is positioned relatively closely to the valve closing point Pc, the first gradient cam surface $d_5$ having a radial height of about A/3, a gradual downward gradient cam surface $e_2$, less steep than the first steep gradient cam surface $d_5$, sloping progressively downwardly or radially inwardly from the first intermediate point $P_5$ toward a second intermediate point $P_6$ near the valve opening point Po, the gradual gradient cam surface $e^2$ having a radial height of about A/3, and a second steep downward gradient cam surface $d_6$ sloping progressively downwardly or radially inwardly from the second intermediate point $P_6$ toward the valve opening point Po and having a radial height of about A/3.

The cam profile shown in FIG. 22 can offset large valve-lifting radial displacement of the base circle portion Cb immediately after the engine valve 4 is closed and immediately before the engine valve 4 is opened, and also small valve-lifting displacement of the base-circle portion Cb during an intermediate interval of the valve closing period.

Figure 23:
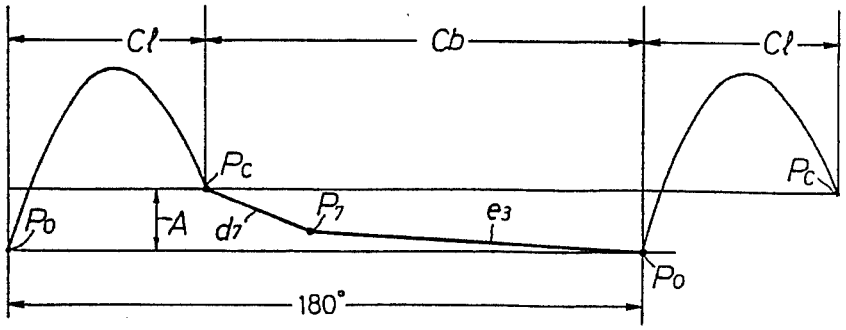

FIG. 23 illustrates a cam profile according to a yet further modification. In FIG. 23, the base circle portion Cb has a radial height A, and comprises a steep downward gradient cam surface $d_7$ sloping progressively downwardly or radially inwardly from the valve closing point Pc toward an intermediate point $P_7$ which is positioned relatively closely to the valve closing point Pc, the gradual gradient cam surface $d_7$ having a radial height of about 2A/3, and a gradual downward gradient cam surface $e_3$, less steep than the steep gradient cam surface $d_7$, sloping progressively downwardly or radially inwardly from the intermediate point $P_7$ toward the valve opening point Po and having a radial height of about A/3.

The cam profile of FIG. 23 is effective in canceling out large valve-lifting radial displacement of the base circle portion Cb immediately after the engine valve 4 is closed and subsequent small valve-lifting radial displacement of the base circle portion Cb.

Figure 24:
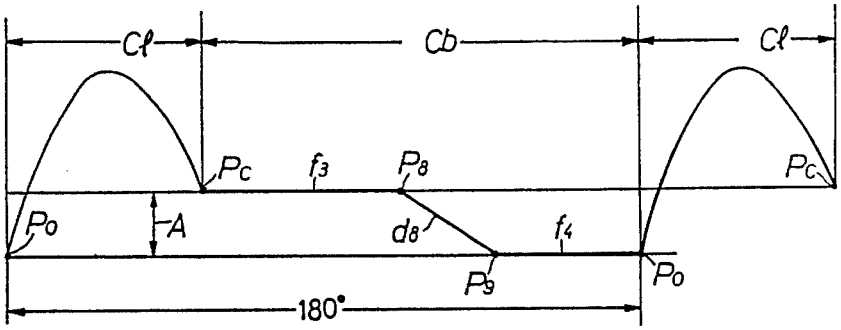

According to another modified cam profile shown in FIG. 24, the base circle portion Cb comprises a first flat or no-gradient cam surface $f_3$ extending with constant radius from the valve closing point Pc to a first intermediate point $P_8$ near the center of the base circle portion Cb, a steep downward gradient cam surface $d_8$ sloping progressively downwardly or radially inwardly from the first intermediate point $P_8$ to a second intermediate point $P_9$ and having a radial height A, and a second flat or constant radius cam surface $f_4$ extending with no gradient from the second intermediate point $P_9$ to the valve opening point Po.

The cam profile shown in FIG. 24 can offset large valve-lifting radial displacement of the base circle portion Cb during an intermediate interval in the valve closing period.

Figure 25:
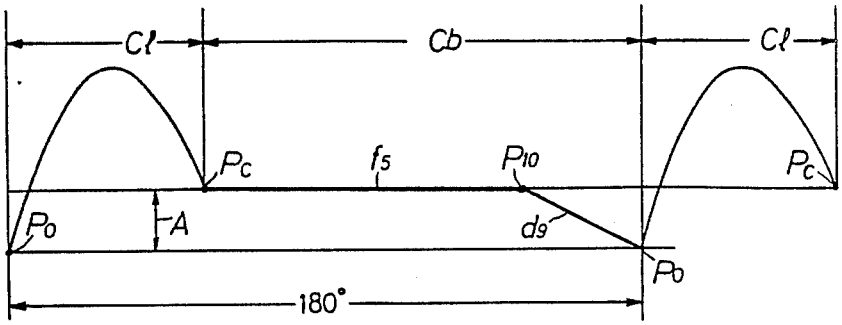

According to a further modification shown in FIG. 25, the base circle portion Cb of the cam profile comprises a flat or constant radius cam surface $f_5$ extending with no gradient from the valve closing point Pc to an intermediate point $P_{10}$ relatively close to the valve opening point Po, and a steep downward gradient cam surface $d_9$ sloping progressively downwardly or radially inwardly from the intermediate point $P_{10}$ to the valve opening point Po and having a radial height A.

The cam profile shown in FIG. 25 can offset large valve-lifting radial displacement of the base circle portion Cb immediately before the engine valve 4 is opened.

Figure 26:
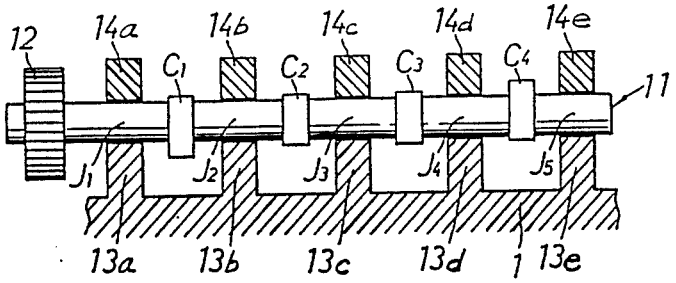
FIG. 26 is a longitudinal cross-sectional view showing a cam shaft and a structure supporting the camshaft.

FIG. 26 shows a valve operating device in which the camshaft 11 has first through fourth cams C1 through C4 located at axially spaced intervals, a toothed pulley 12 on one end thereof which can be rotated at a reduced speed by a crankshaft through a timing belt (not shown), and first through fifth journals J1 through J5 successively positioned along the axis of the camshaft 11. The cams C1 through C4 are disposed between the journals J1 through J5.

The first through fifth journals J1 through J5 are rotatably supported by a plurality of lower bearing members 13*a* through 13*e* integrally formed with the cylinder head 1 and a plurality of upper bearing members 14*a* through 14*e* fastened to the lower bearing members 13*a* through 13*e*, respectively.

Each of the cams C1 through C4 has a cam profile as shown in FIG. 10.

Figure 27:
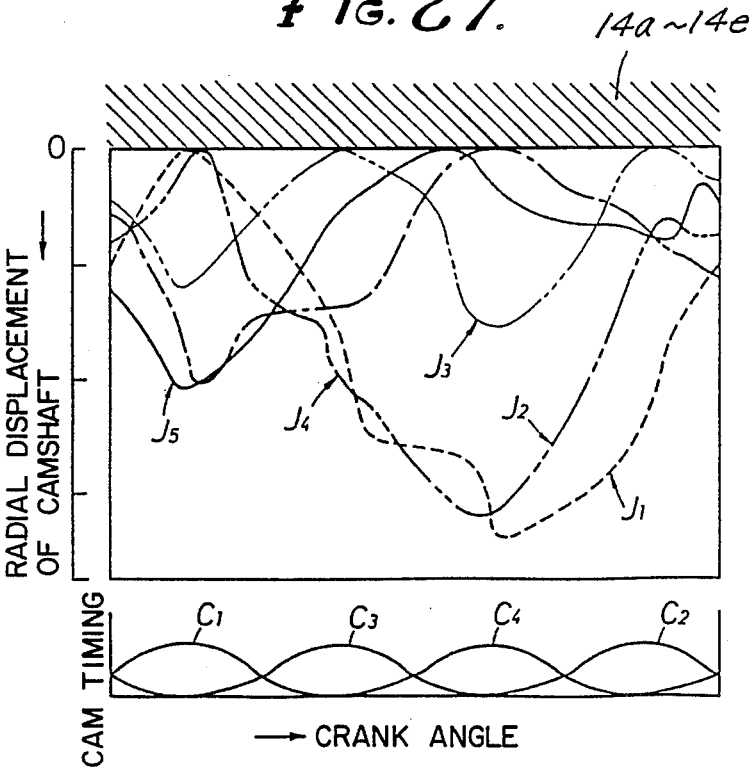
FIG. 27 is a diagram illustrating the manner in which journals are radially displaced while the camshaft is being rotated.

While the camshaft 11 is being rotated, the first through fifth journals $J_1$ through $J_8$ are radially displaced downwardly as shown in FIG. 27, the displacements being measured from the inner surfaces of the upper bearing members 14*a* through 14*e*. Based on the measured radial displacements of the journals, valve-lifting radial displacements of the base circle portions Cb of the respective first through fourth cams C1 through C4 are estimated, and the cam profiles of the base circle portions Cb of the cams C1 through C4 are determined in symmetrical relation to the estimated valve-lifting radial displacements.

Figure 28:
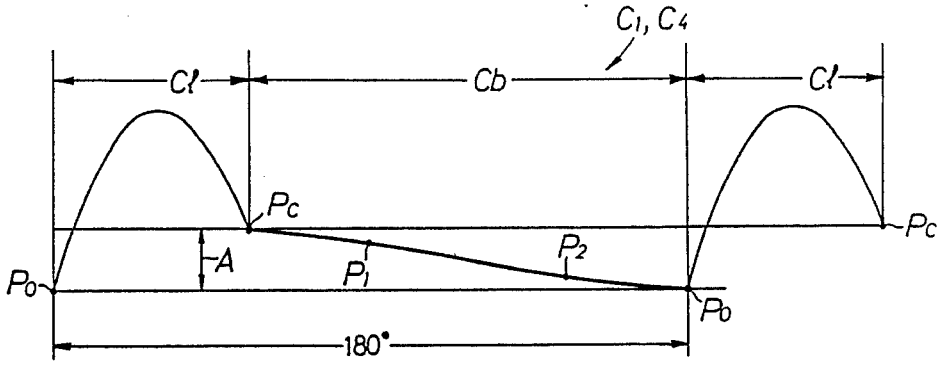
FIGS. 28 and 29 are diagrams showing cam profiles according to further modifications.

More specifically, as shown in FIG. 28, each of the base circle portions Cb of the first and fourth cams C1, C4 has a radial height A, and comprises a first gradual downward gradient cam surface $e_1$ sloping progressively downwardly or radially inwardly from the valve closing point Pc toward a first intermediate point $P_1$ near the valve closing point Pc, the first gradient cam surface $e_1$ having a radial height of about A/5, a steep downward gradient cam surface d, steeper than the gradient cam surface $e_1$, sloping progressively downwardly or radially inwardly from the first intermediate point $P_1$ toward a second intermediate point $P_2$ relatively close to the valve opening point Po, the gradient cam surface d having a radial height of about 3A/5, and a second gradual downward gradient cam surface $e_2$ sloping progressively downwardly or radially inwardly from the second intermediate point $P_2$ toward the valve opening point Po, the gradient cam surface $e_2$ having a radial height of about A/5.

Figure 29:
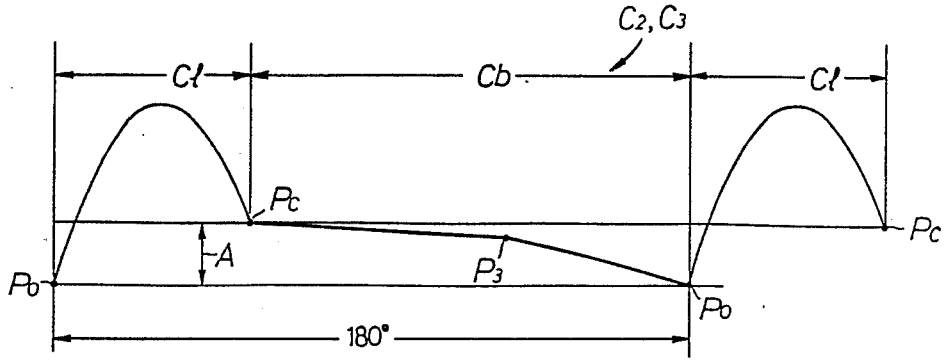

As shown in FIG. 29, each of the base circle portions Cb of the second and third cams C2, C3 has a radial height A, and comprises a gradual downward gradient cam surface e sloping progressively downwardly or radially inwardly from the valve closing point Pc toward an intermediate point $P_3$ near the center of the base circle portion Cb, the gradient cam surface e having a radial height of about A/5, and a steep downward gradient cam surface d, steeper than the gradient cam surface e, sloping progressively downwardly or radially inwardly from the intermediate point $P_3$ toward the valve opening point Po, the gradient cam surface d having a radial height of about 4A/5.

When the base circle portion Cb of each of the first and fourth cams C1, C4 is rotated in sliding contact with the slipper surface 10*a* (FIG. 10), the plunger 22 is extended successively along the gradient cam surfaces $e_1$, d, $e_2$. Therefore, even if the base circle portion Cb of each of the first and fourth cams C1, C4 is radially displaced in a direction to lift the engine valve 4 in symmetrical relation to the gradient cam surfaces $e_1$, d, $e_2$, such valve-lifting displacements of the base circle portions Cb are offset by these gradient cam surfaces, thereby preventing the check valve 29 in the hydraulic lash adjuster 9 from being closed.

Similarly, when the base circle portion Cb of each of the second and third cams C2, C3 is rotated in sliding contact with the slipper surface 10*a* (FIG. 10), the plunger 22 is extended successively along the gradient cam surfaces e, d. Therefore, even if the base circle portion Cb of each of the second and third cams C2, C3 is radially displaced in a direction to lift the engine valve 4 in symmetrical relation to the gradient cam surfaces e, d, such valve-lifting displacements of the base circle portions Cb are offset by these gradient cam surfaces, thereby preventing the check valve 29 in the hydraulic lash adjuster 9 from being closed.

Any valve-lifting radial displacement of the cams C1 through C4 which cannot be offset by the gradients of the base circle portion Cb can be canceled out by the play $L_0$ in the hydraulic lash adjuster 9 itself.

Figure 30:
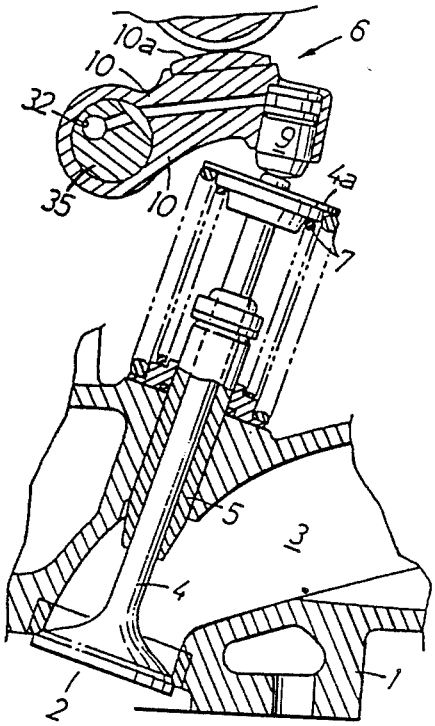
FIG. 30 is a vertical cross-sectional view of a valve operating device according to a further embodiment of the present invention.

FIG. 30 shows a valve operating device according to a further embodiment of the present invention. In this embodiment, a hydraulic lash adjuster 9 is mounted in a distal end of a cam follower or rocker arm 10 swingably supported on a fixed rocker shaft 35. The hydraulic lash adjuster 9 has a plunger end held against the upper end of the valve stem of an engine valve 4. The fixed rocker shaft 35 has an oil passage 32 defined therein and communicating with the plunger in the hydraulic lash adjuster 9 through a passage in the cam follower 10. The hydraulic lash adjuster 9 is identical in structure to the hydraulic lash adjuster shown in FIG. 2. The valve operating device includes a cam C which may be of the cam profile of any of the various cams described above.

Although certain preferred embodiments have been shown and described, it should be understood that many changes and modifications may be made therein without departing from the scope of the appended claims.

What is claimed is:

1. A valve operating device for operating an engine valve in an internal combustion engine, comprising:

a valve spring for normally urging the engine valve in a closing direction;

a cam having a cam profile including a valve lifting portion for applying a force to open said engine valve and a base circle portion for allowing said valve to be closed, said cam profile having a valve opening point and a valve closing point between said valve lifting portion and said base circle portion;

transmitting means for transmitting the force from said cam to said engine valve;

a hydraulic lash adjuster combined with said transmitting means for eliminating any gap between said means and said engine valve, said hydraulic lash adjuster comprising an oil pressure chamber, a plunger movable into said oil pressure chamber in response to the force from said transmitting means and defining an oil chamber therein which normally communicates with said oil pressure chamber through a valve hole defined in said plunger, and a free-ball-type check valve which is movable to close said valve hole only dependent on a pressure buildup in said oil pressure chamber; and said base circle portion of the cam profile having a downward gradient surface sloping progressively radially inwardly from said valve closing point toward said valve opening point, said base circle portion having a radial height A, as converted to the stroke of movement of said plunger, between said valve closing and opening points, said radial height A being selected to meet the following relationship:

$$l_{1B}+L<A\leqq l_{1A}+l_{1B}+L$$

where $l_{1A}$ represents the amount of initial depression of said plunger which is required to cause said check valve to close said valve hole;

$l_{1B}$ represents the amount of resilient depression of said plunger which is caused by the compression of air bubbles in oil in said oil pressure chamber; and L represents the amount of depression of said plunger upon oil leakage from said oil pressure chamber while said engine valve is being closed.

2. A valve operating device according to claim 1, wherein said radial height A is selected to meet the relationship:

$$A+l_2>A+l_{1B}$$

where $l_2$ represents the amount of returning movement of said plunger when the plunger is released from the force applied by said cam to open the engine valve.

3. A valve operating device for operating an engine valve in an internal combustion engine, comprising:

a valve spring for normally urging the engine valve in a closing direction;

a cam having a cam profile including a valve lifting portion for applying a force to open said engine valve and a base circle portion for allowing said valve to be closed, said cam profile having a valve opening point and a valve closing point between said valve lifting portion and said base circle portion;

transmitting means for transmitting the force from said cam to said engine valve;

a hydraulic lash adjuster combined with said transmitting means for eliminating any gap between said means and said engine valve;

said base circle portion of the cam profile having a downward gradient surface sloping progressively radially inwardly from said valve closing point toward an intermediate point between said valve closing and opening points, and an upward gradient surface sloping progressively radially outwardly from said intermediate point toward said valve opening point, said upward gradient surface having a gradient smaller than the gradient of a valve opening curve of said valve lifting portion.

4. A valve operating device according to claim 3, wherein said downward gradient surface has a radial height A, as converted to the stroke of movement of said hydraulic lash adjuster, and said upward gradient surface has a radial height B, as converted to the stroke of movement of said hydraulic lash adjuster, said radial heights A and B being selected to meet the following relationship:

$$L_0\geqq A\geqq B$$

where $L_0$ represents the play in said hydraulic lash adjuster.

5. A valve operating device according to claim 4, wherein said hydraulic lash adjuster comprises an oil pressure chamber, a plunger movable into said oil pressure chamber in response to the force from said transmitting means and defining an oil chamber therein which normally communicates with said oil pressure chamber through a valve hole defined in said plunger, and a free-ball-type check valve which is movable to close said valve hole only dependent on a pressure buildup in said oil pressure chamber, said play $L_0$ meeting the following relationship:

$$L_0=l_{1A}+l_{1B}+L$$

where $l_{1A}$ represents the amount of initial depression of said plunger which is required to cause said check valve to close said valve hole;

$l_{1B}$ represents the amount of resilient depression of said plunger which is caused by the compression of air bubbles in oil in said oil pressure chamber; and L represents the amount of depression of said plunger upon oil leakage from said oil pressure chamber while said engine valve is being closed.

6. A valve operating device according to claim 3, wherein said radial height A of said downward gradient surface and said radial height B of said upward gradient surface are equal to each other.

7. A valve operating device according to claim 3, wherein the gradient of said upward gradient surface is larger than the gradient of said downward gradient surface.

8. A valve operating device according to claim 3, wherein the gradient of said downward gradient surface is larger than the gradient of said upward gradient surface.

9. A valve operating device for operating an engine valve in an internal combustion engine, comprising:

a valve spring for normally urging the engine valve in a closing direction;

a cam having a cam profile including a valve lifting portion for applying a force to open said engine valve and a base circle portion for allowing said valve to be closed, said cam profile having a valve opening point and a valve closing point between said valve lifting portion and said base circle portion;

transmitting means for transmitting the force from said cam to said engine valve;

a hydraulic lash adjuster combined with said transmitting means for eliminating any gap between said means and said engine valve;

said base circle portion of the cam profile having a first downward gradient surface sloping progressively radially inwardly from said valve closing point toward a first intermediate point between said valve closing and opening points, an upward gradient surface sloping progressively radially outwardly from said first intermediate point toward a second intermediate point between said first intermediate point and said valve opening point, said upward gradient surface having a gradient smaller than the gradient of a valve opening curve of said valve lifting portion, and a second downward gradient surface sloping progressively radially outwardly from said second intermediate point toward said valve opening point or a third intermediate point between said second intermediate point and said valve opening point, said first downward gradient surface has a radial height A, as converted to the stroke of movement of said hydraulic lash adjuster, and said base circle portion has a radial height B, as converted to the stroke of movement of said hydraulic lash adjuster, between said first intermediate point and said valve opening point, said radial heights A and B being selected to meet the following relationship:

$$A \geqq B$$

$$L_0 \geqq A - B$$

where $L_0$ represents the play in said hydraulic lash adjuster.

10. A valve operating device according to claim 9, wherein said hydraulic lash adjuster comprises an oil pressure chamber, a plunger movable into said oil pressure chamber in response to the force from said transmitting means and defining an oil chamber therein which normally communicates with said oil pressure chamber through a valve hole defined in said plunger, and a free-ball-type check valve which is movable to close said valve hole only dependent on a pressure buildup in said oil pressure chamber, said play $L_0$ meeting the following relationship:

$$L_0 = l_{1A} + l_{1B} + L$$

where $l_{1A}$ represents the amount of initial depression of said plunger which is required to cause said check valve to close said valve hole;

$l_{1B}$ represents the amount of resilient depression of said plunger which is caused by the compression of air bubbles in oil in said oil pressure chamber; and L represents the amount of depression of said plunger upon oil leakage from said oil pressure chamber while said engine valve is being closed.

11. A valve operating device according to claim 9, wherein said upward gradient surface has a radial height D which is smaller than said radial height A of said first downward gradient surface.

12. A valve operating device according to claim 9, wherein said upward gradient surface has a radial height D which is equal to said radial height A of said first downward gradient surface.

13. A valve operating device according to claim 9, wherein said upward gradient surface has a radial height D which is larger than said radial height A of said first downward gradient surface.

14. A valve operating device according to claim 9, wherein said first intermediate point and said valve opening point are on the same radial level.

15. A valve operating device according to claim 9, wherein said base circle portion of the cam profile further includes a second upward gradient surface sloping progressively radially outwardly from said third intermediate point toward said valve opening point, said second upward gradient surface having a gradient smaller than the gradient of the valve opening curve of said valve lifting portion, said valve closing and opening points being on the same radial level.

16. A valve operating device according to claim 9, wherein said base circle portion of the cam profile further a plurality of alternating upward and downward gradient surfaces extending between said first intermediate point and said valve opening point and each having a radial height smaller than the gradient A of said first downward gradient surface.

17. A valve operating device for operating an engine valve in an internal combustion engine, comprising:

a valve spring for normally urging the engine valve in a closing direction;

a cam having a cam profile including a valve lifting portion for applying a force to open said engine valve and a base circle portion for allowing said valve to be closed, said cam profile having a valve opening point and a valve closing point between said valve lifting portion and said base circle portion;

transmitting means for transmitting the force from said cam to said engine valve;

a hydraulic lash adjuster combined with said transmitting means for eliminating any gap between said means and said engine valve;

said base circle portion of the cam profile having a steep downward gradient surface sloping progressively radially inwardly from said valve closing point toward a first intermediate point between said valve closing and opening points, and a no-gradient surface extending from said first intermediate point toward said valve opening point, said base circle portion has a radial height A, as converted to the stroke of movement of said hydraulic lash adjuster, between said valve closing and opening points, said radial height A being selected to meet the following relationship:

$$A \leqq L_0$$

where $L_0$ represents the play in said hydraulic lash adjuster.

18. A valve operating device according to claim 17, wherein said hydraulic lash adjuster comprises an oil pressure chamber, a plunger movable into said oil pressure chamber in response to the force from said transmitting means and defining an oil chamber therein which normally communicates with said oil pressure chamber through a valve hole defined in said plunger, and a free-ball-type check valve which is movable to close said valve hole only dependent on a pressure buildup in said oil pressure chamber, said play $L_0$ meeting the following relationship:

$$L_0 = l_{1A} + l_{1B} + L$$

where $l_{1A}$ represents the amount of initial depression of said plunger which is required to cause said check valve to close said valve hole;

$l_{1B}$ represents the amount of resilient depression of said plunger which is caused by the compression of air bubbles in oil in said oil pressure chamber; and L represents the amount of depression of said plunger upon oil leakage from said oil pressure chamber while said engine valve is being closed.

19. A valve operating device according to claim 17, wherein said base circle portion of the cam profile further includes a second steep downward gradient surface sloping progressively radially inwardly from said no-gradient surface toward said valve opening point.

20. A valve operating device for operating an engine valve in an internal combustion engine, comprising:

a valve spring for normally urging the engine valve in a closing direction;

a cam having a cam profile including a valve lifting portion for applying a force to open said engine valve and a base circle portion for allowing said valve to be closed, said cam profile having a valve opening point and a valve closing point between said valve lifting portion and said base circle portion;

transmitting means for transmitting the force from said cam to said engine valve;

a hydraulic lash adjuster combined with said transmitting means for eliminating any gap between said means and said engine valve;

said base circle portion of the cam profile having a gradual downward gradient surface sloping progressively radially inwardly from said valve closing point toward an intermediate point between said valve closing and opening points, and a steep downward gradient surface extending from said intermediate point toward said valve opening point, said steep downward gradient surface being steeper than said gradual downward gradient surface, said base circle portion has a radial height A, as converted to the stroke of movement of said hydraulic lash adjuster, between said valve closing and opening points, said radial height A being selected to meet the following relationship:

$$A \leqq L_0$$

where $L_0$ represents the play in said hydraulic lash adjuster.

21. A valve operating device for operating an engine valve in an internal combustion engine, comprising:

a valve spring for normally urging the engine valve in a closing direction;

a cam having a cam profile including a valve lifting portion for applying a force to open said engine valve and a base circle portion for allowing said valve to be closed, said cam profile having a valve opening point and a valve closing point between said valve lifting portion and said base circle portion;

transmitting means for transmitting the force from said cam to said engine valve;

a hydraulic lash adjuster combined with said transmitting means for eliminating any gap between said means and said engine valve;

said base circle portion of the cam profile having a steep downward gradient surface sloping progressively radially inwardly from said valve closing point toward an intermediate point between said valve closing and opening points, and a gradual downward gradient surface extending from said intermediate point toward said valve opening point, said gradual downward gradient surface being less steep than said steep downward gradient surface, said base circle portion has a radial height A, as converted to the stroke of movement of said hydraulic lash adjuster, between said valve closing and opening points, said radial height A being selected to meet the following relationship:

$$A \leqq L_0$$

where $L_0$ represents the play in said hydraulic lash adjuster.

22. A valve operating device according to claim 20 or 21, wherein said base circle portion of the cam profile further includes a second steep downward gradient surface sloping progressively radially inwardly from said gradual gradient surface toward said valve opening point, said second steep downward gradient surface being steeper than said gradual gradient surface.

23. A valve operating device for operating an engine valve in an internal combustion engine, comprising:

a valve spring for normally urging the engine valve in a closing direction;

a cam having a cam profile including a valve lifting portion for applying a force to open said engine valve and a base circle portion for allowing said valve to be closed, said cam profile having a valve opening point and a valve closing point between said valve lifting portion and said base circle portion;

transmitting means for transmitting the force from said cam to said engine valve;

a hydraulic lash adjuster combined with said transmitting means for eliminating any gap between said means and said engine valve;

said base circle portion of the cam profile having a no-gradient surface sloping progressively radially inwardly from said valve closing point toward an intermediate point between said valve closing and opening points, and a steep downward gradient surface extending from said intermediate point toward said valve opening point, said base circle portion has a radial height A, as converted to the stroke of movement of said hydraulic lash adjuster, between said valve closing and opening points, said radial height A being selected to meet the following relationship:

$$A \leqq L_0$$

where $L_0$ represents the play in said hydraulic lash adjuster.

24. A valve operating device according to claim 23, wherein said base circle portion of the cam profile further includes a second no-gradient surface extending from said steep downward gradient surface toward said valve opening point.

25. A valve operating device for operating a plurality of engine valves in an internal combustion engine, comprising:

a plurality of valve springs for normally urging the engine valves in a closing direction;

a plurality of cams having respective cam profiles including respective valve lifting portions for applying forces to open said engine valves and respective base circle poritons for allowing said valves to be closed;

transmitting means for transmitting the force from each of said cams to said engine valve;

a hydraulic lash adjuster combined with said transmitting means for eliminating any gap between said means and each of said engine valves; and the base circle portions of at least selected ones of said cams having profiles differing from the profiles of the base circle poritons of the others of said cams dependent upon the respective radial displacements thereof in a direction to lift the engine valves.

26. A valve operating device according to any one of claims 1, 3, 9, 17, 20, 21, 23, or 25, wherein said transmitting means comprises a cam follower held in slidable contact with said cam or said each cam, said hydraulic lash adjuster being mounted in said cam follower.

* * * * *